United States Patent [19]

Murphy

[11] 4,375,110

[45] Mar. 1, 1983

[54] HAMMOCK, ESPECIALLY BABY HAMMOCK

[76] Inventor: Joyce O. Murphy, Northwood Crafts, Box 18, Strong, Me. 04983

[21] Appl. No.: 265,378

[22] Filed: May 20, 1981

[51] Int. Cl.[3] ..... A47D 7/04

[52] U.S. Cl. ..... 5/98 B; 5/122; 403/291; 403/220

[58] Field of Search ..... 5/120–127, 5/98 B; 403/220, 291

[56] References Cited

U.S. PATENT DOCUMENTS

| | | | |
|---|---|---|---|
| 370,222 | 9/1887 | Travers | 5/122 X |
| 894,008 | 5/1908 | Ince | 5/120 |
| 962,092 | 6/1910 | Palmer | 5/98 B |
| 4,221,429 | 9/1980 | Wade | 5/121 X |

FOREIGN PATENT DOCUMENTS

| | | | |
|---|---|---|---|
| 128387 | 3/1946 | Australia | 5/123 |

*Primary Examiner*—Francis K. Zugel

*Attorney, Agent, or Firm*—W. G. Fasse; D. H. Kane, Jr.

[57] ABSTRACT

A baby hammock should be washable. Therefore, any non-washable components should be easily removable from the washable components. The reassembly of the components should be simple. For this purpose the present hammock has longitudinal, open ended pockets or channels extending along the upper edges of the side panels and of the end panels of the hammock body. Wooden rods, also referred to as dowels, are inserted into these pockets. The ends of the rods overlap at each corner of the hammock body. Ropes interconnect the overlapping rod ends and simultaneously serve as suspension elements. The ropes extend through one or several rings at the upper rope ends. The lower rope ends pass through and around the rod ends and are tied for a safe connection. The tying is easily untied for removing the rods.

9 Claims, 7 Drawing Figures

FIG. 1
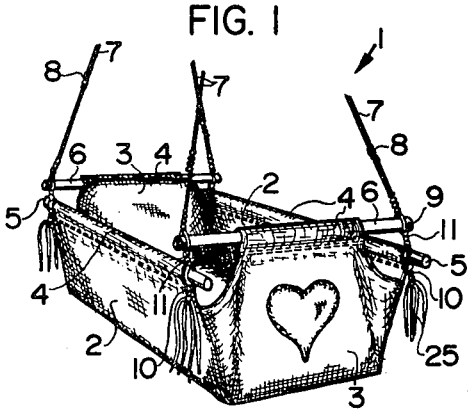
FIG. 2
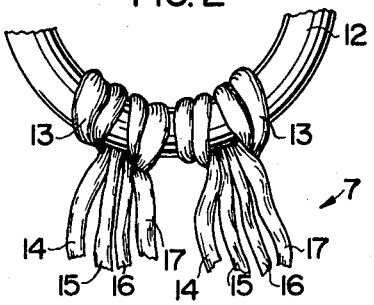
FIG. 3
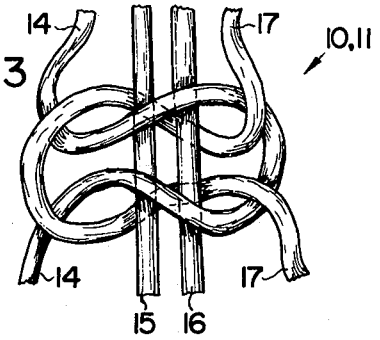
FIG. 4
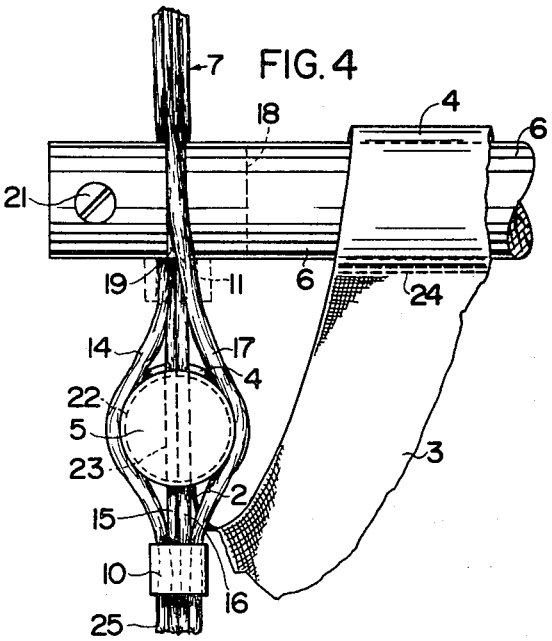
FIG. 5
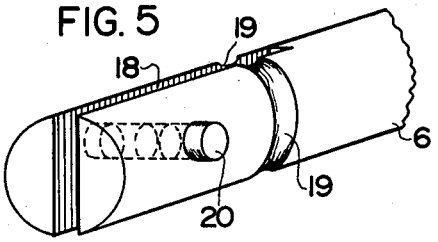
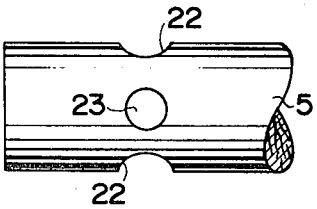
FIG. 6
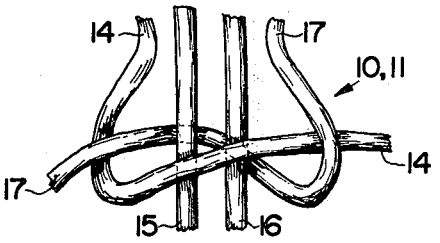
FIG. 7

HAMMOCK, ESPECIALLY BABY HAMMOCK

BACKGROUND OF THE INVENTION

The present invention relates to a hammock, especially a baby hammock of the type which may be suspended, for example, from the ceiling, and which is versatile in its use, yet simple in its construction.

Baby hammocks have been manufactured heretofore, whereby three basic hammock types appear to exist. The first hammock type employs hinged metal components forming a frame. Due to the hinges it is possible to fold the hammock into a smaller shape for storage or transportation. The second type of hammock may also be assembled and disassembled and folded into a smaller shape. For this purpose the second type employs a multi-component frame structure of rods and tubular members, whereby the rod ends are inserted into the open ends of the tubular members substantially in a telescoping manner with additional means for locking the frame components into a fixed position relative to each other once the frame is assembled. The third type of hammock minimizes the use of frame components and such frame components, if used, are tied together by pieces or cord or rope or held by rivets or screws.

U.S. Pat. No. 2,636,190 is considered to be representative of hammocks having a metal frame with foldable hinges. The hammock body is made of fabric and the upwardly open edges of the hammock body have flaps which are foldable around the metal frame components. Snap fasteners are used for securing the flaps to the hammock body once the flaps are folded around the metal frame parts. This type of structure leaves room for improvement because the metal frame is rather expensive and because the hammock body is actually not machine washable even though it can be removed from the metal frame.

U.S. Pat. No. 1,376,476 is considered to be representative of structures in which the frame components comprise rods and tubular members into which the free ends of the rods are inserted. The rods and tubular members are provided with interlocking elements to avoid an inadvertent separation of a rod from a tubular member. The frame structure in U.S. Pat. No. 1,376,476 is arranged so as to extend out of and away from the hammock body proper so that the child resting in the hammock cannot touch the frame. This known structure is supposed to be foldable, but it is doubtful whether it can be easily assembled and disassembled. Similar considerations apply to all other prior art structures falling into this group.

The third group which avoids using frame members is represented by U.S. Pat. No. 1,237,628. This reference discloses a hammock sewn together in the manner of a bag with a open side and without any stiffening components other than the supporting straps. U.S. Pat. Nos. 2,467,890 and 1,225,208 also fall into this group, however, with the exception that stiffening members are used. Such stiffening members do not form an interconnected frame structure.

U.S. Pat. Nos. 595,235 and 962,092 show an approach which minimizes the use of frame components, thus, in U.S. Pat. No. 595,235 four rods are interconnected at the corners by rivets or bolts and two of the rods are hinged intermediate the ends for folding. The suspending ropes are tied to the bars. For this purpose the lower ends of the ropes extend through separate holes in the bars. Thus, these ropes serve merely for the suspension purpose. The structure of U.S. Pat. No. 962,092 is quite similar to that of U.S. Pat. No. 595,235 except that the slats or rods are not hinged intermediate the ends. The slats or rods are interconnected at the corners by a piece of rope which is separate from the suspension ropes. The piece of rope which interconnects the slats is made long enough so as to permit a certain hinging movement of the end slats or bars between a hammock suspending position and a non-use position. Here again the suspending ropes serve only for the suspending purpose.

OBJECTS OF THE INVENTION

In view of the above it is the aim of the invention to achieve the following objects singly or in combination:

to construct a hammock, especially a baby hammock, in which any washable parts, such as the hammock body, are easily and quickly assembled with or disassembled from any non-washable parts;

to arrange the components of a hammock in such a manner that it may be rolled up for storage or transportation;

to construct a hammock substantially without any metal parts, especially without any metal frame components;

to suspend a hammock selectively from one or two hooks;

to construct a hammock so that it may be used as a carrying case for a baby; and to construct a hammock so that it may be assembled and disassembled by tying or untying knots only, whereby the suspending ropes simultaneously serve for two purposes, namely the suspending and for holding wooden frame members together.

SUMMARY OF THE INVENTION

The hammock according to the invention comprises a hammock body with four corners. The hammock body is made of a washable material such as a fabric and has two longitudinal side panels, two end panels, and a bottom. Each panel has an upper edge and rod holding means secured to each upper edge. Two stiff longitudinal rods are operatively held by the respective rod holding means of the longitudinal panels. Two stiff end rods are operatively held by the respective rod holding means of the end panels. The stiff longitudinal rods and the stiff end rods have such a length that the rod ends overlap at each of the four corners of the hammock body. Four rope means interconnect the respective overlapping rod ends at each of the four corners and the same rope means simultaneously suspend the hammock, whereby each rope means performs simultaneously two functions, namely, a rod connecting function and a hammock suspending function.

The advantages of the present hammock are seen in that by simply untying a few knots the non-washable rods may be withdrawn from the pockets of the hammock forming panels which are then machine washable. The assembly is similarly easy by inserting the rods, for example, in the form of dowels into the open ended pockets and retying the knots. Another advantage is seen in that by simply reducing the length of the suspending ropes the present hammock may be used as a carrying case, whereby the ropes perform yet a third function while still permitting the end bars or rods to keep the hammock from folding up. Further, the present hammock is very simple because it avoids hingeable and foldable metal frame components, whereby the manufacture of the hammock is also greatly simplified so that it may be made by using simple hand tools and a sewing machine.

BRIEF FIGURE DESCRIPTION

In order that the invention may be clearly understood, it will now be described, by way of example, with reference to the accompanying drawings, wherein:

FIG. 1 is a perspective view of a hammock according to the invention;

FIG. 2 shows on an enlarged scale relative to FIG. 1, the connection of two sets of ropes to a suspending ring;

FIG. 3 shows one type of knot that may be used according to the invention for holding the rods together and simultaneously suspend the hammock;

FIG. 4 is an enlarged end view onto a corner construction according to the invention;

FIG. 5 shows an end portion of a rod or dowel provided with a slot and grooves to receive the suspending and tying ropes;

FIG. 6 is a view of a modified end of a rod or bar with a hole and groove for receiving the suspending and tying ropes; and FIG. 7 shows another type of knot that may be used for the present purposes.

DETAILED DESCRIPTION OF PREFERRED EXAMPLE EMBODIMENTS AND OF THE BEST MODE OF THE INVENTION

FIG. 1 shows the hammock 1 comprising a hammock body with four corners. The hammock body is made of washable material for example, canvas or any other suitable fabric. The hammock body has longitudinal side panels 2, end panels 3, and a bottom. Rod holding means 4 such as open ended pockets 4 or loops are secured to each upper edge of the side and end panels. These open ended pockets 4 may be formed, for example, by folding over a portion of the respective panel along the upper edge thereof and providing one or several rows of stitches 24 as shown in FIG. 4.

Two longitudinal, stiff rods such as wooden dowels 5 are inserted into the open ended pockets 4 of the side panels 2. Two shorter, stiff end rods such as wooden dowels 6 are inserted into the open ended pockets 4 of the end panels 3. The length of these dowels 5 and 6 is such that they overlap at the corners as shown in FIG. 1. Four rope means 7 or sets of ropes are used according to the invention to perform the function of suspending the hammock from an overhead fixed point and for interconnecting the overlapping rod ends as will be described below in more detail. Four single ropes may be used to form the set of ropes 7. However, it is preferable to use a plurality of ropes as shown in FIG. 2. Each rope may be provided with decorations such as wooden beads 8. The rope ends extend through openings in each rod end and knots 10, 11 are provided for interconnecting the rod ends and for securing the ropes to the rod ends. Additional safety means 9 may extend through the rod ends to prevent the ropes from slipping out of an opening at the rod end if the opening is an axial slot.

As shown in FIG. 2 it is preferable that the suspending rope means 7 comprise four groups of ropes formed by using eight lengths of rope in pairs of cords doubled back intermediate the ends thereof to form a noose 13 through which a ring 12 extends. Each doubled back pair of cords provides four rope ends 14, 15, 16, and 17. Four of these free rope ends 14, 15, 16, 17 are used in each corner construction as will now be described with reference to FIGS. 4, 5, and 6. The upper edges of the longitudinal side panels 2 extend to a level lower than the level of the upper edges of the end panel 3, whereby the stiff end rods 6 extend above the stiff longitudinal rods 5. The rope ends 15 and 16 extend through a clothespin type of notch 18 in the rod or dowel 6 and the rope ends 14 and 17 extend through the grooves 19, whereby the rope ends are held in place. A peg 20 shown in FIG. 5 may be used as a safety means 9. Such a peg may also be replaced by a stove bolt 21 as shown in FIG. 4.

The rope ends 15 and 16 further extend through a hole 23 in the end of the longitudinal dowel 5 and the rope ends 14 and 17 may further extend through notches 22 as best seen in FIG. 6. One or several knots 11 may be provided below the end dowel 6. Such knots are shown symbolically in FIG. 4. However, knots of the type shown in FIGS. 3 or 7 may be used for this purpose. One or several knots 10 also shown symbolically in FIG. 4 will further be provided below the dowel 5, whereby again knots of the type shown in FIGS. 3 and 7 may be used. Other knot types may also be suitable.

Due to the grooves 19 in FIG. 5 or 22 in FIG. 6, the ropes are already held in place, especially when the knots 10 and 11 are tied closely to the respective dowel 5 or 6. However, for safety purposes it is advisable to use a peg 20 when the dowels are provided with clothespin type notches 18. All the dowels 5 and 6 may be provided with clothespin type notches at both ends or all dowels may be provided with holes and grooves as shown in FIG. 6

As shown, the lower dowels 5 are provided with holes 23 and grooves 22, whereas the upper end dowels 6 are provided with notches 18, however, the invention is not limited to this combination.

Further, although round dowels have been illustrated, the invention may also be practiced by using, for example, square or rectangular dowels. Making the end panel 3 somewhat higher has the advantage that, for example, a cushion may conveniently rest against one of the end panels. However, again the invention is not limited to this arrangement of the end panels. It is quite possible to let the side panels 2 extend above the end panels 3.

In the light of the above disclosure it will be appreciated that it is very simple to assemble and disassemble the present hammock without any tools because a stop member such as the peg 20 or a bolt 21 may be removed by hand since the peg is inserted with a very light press fit.

Although the invention has been described with reference to specific example embodiments, it will be appreciated that it is intended to cover all modifications and equivalents within the scope of the appended claims.

What is claimed is:

1. A hammock, comprising a hammock body with four corners and made of a suitable material having longitudinal side panels, end panels and a bottom, each panel having an upper edge and rod holding means secured to each other edge, two stiff longitudinal rods operatively held by the respective rod holding means of the longitudinal panels, two stiff end rods operatively held by the respective rod holding means of the end panels, said stiff longitudinal rods and said stiff end rods having such a length that the rod ends overlap at each of said four corners, and four rope means for interconnecting the respective overlapping rod ends at each of the four corners and for suspending the hammock whereby each rope means is provided for performing simultaneously a rod connecting function and a hammock suspending function, wherein each of the four rope means comprises a set of four lengths of rope, each set forming a suspension end and a group of four free rope ends, said hammock further comprising means for connecting said four free rope ends to both overlapping ends of the rods at the respective corner, and wherein said connecting means comprise an opening through each of said rod ends, wherein two of said four free rope ends at each corner extend through said opening while the remaining two free rope ends extend around the respective rod, and wherein said means for connecting comprise knot means for releasably tying said free rope ends at least below the lower rod end.

2. The hammock of claim 1, further comprising hammock suspending means, and wherein said four rope means comprise four individual ropes connected at the upper end thereof to said hammock suspending means and at the lower end to both overlapping rod ends at the respective one of said four corners.

3. The hammock of claim 1, wherein said stiff rod means are wooden dowels, and wherein said rod holding means in each upper panel edge comprise an open ended pocket in which the respective wooden dowel is received with the dowel ends protruding from the respective pockets at each of said four corners for said overlapping.

4. The hammock of claim 1, wherein the upper edges of said longitudinal side panels extend to a level lower than the level of the upper edges of the end panels whereby the stiff end rods extend above the stiff longitudinal rods.

5. The hammock of claim 1, wherein said stiff rods are wooden dowels, wherein said opening is a hole through the respective dowel end, and wherein said wooden dowels comprise grooves in the sides of the dowels adjacent to the respective opening whereby the remaining two free rope ends extend around the rod in the respective groove.

6. The hammock of claim 1, wherein said stiff rods are wooden dowels, wherein said opening is an axially extending slot at each end of each wooden dowel, and wherein said wooden dowels comprise grooves in the sides of the dowels, whereby said two free rope ends extend through the respective slot and the remaining two free rope ends extend around the rod in the respective groove.

7. The hammock of claim 1, wherein said longitudinal rods are located below the end rods, wherein said opening in the ends of the lower longitudinal rods is a hole extending substantially vertically through each end of the lower longitudinal rods, wherein the opening in the ends of the upper end rods is an axially extending open ended slot in each end of each upper end rod, whereby said two free rope ends extend first through the respective slot and then through the respective hole and whereby the remaining two free rope ends extend first around the respective upper end rod and then around the respective lower longitudinal rod, and wherein said knot means comprise at least one knot below the upper end rod and at least one knot below the lower longitudinal rod.

8. The hammock of claim 7, further comprising a stop member (20) extending through each rod having an axial slot, said stop member passing through the rod so as to keep the two free rope ends passing through the slot in the slot.

9. The hammock of claim 1, wherein said four lengths of rope are formed by doubling back two lengths of rope intermediate the ends thereof to provide a suspension noose and said group of four free rope ends.

* * * * *

UNITED STATES PATENT AND TRADEMARK OFFICE

CERTIFICATE OF CORRECTION

PATENT NO. : 4,375,110

DATED : March 1, 1983

INVENTOR(S) : Joyce O. Murphy

It is certified that error appears in the above-identified patent and that said Letters Patent is hereby corrected as shown below:

In column 4, line 62, "other" should be replaced by --upper--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*